United States Patent [19]

Reinert et al.

[11] 3,961,880

[45] June 8, 1976

[54] CONTINUOUS PROCESS FOR OPTICAL BRIGHTENING AND PRINTING OF ORGANIC TEXTILE FIBER MATERIAL

[75] Inventors: Gerhard Reinert, Allschwil; Andres Schaub, Biel-Benken; Paul Dussy, Basel, all of Switzerland

[73] Assignee: Ciba-Geigy Corporation, Ardsley, N.Y.

[22] Filed: June 18, 1974

[21] Appl. No.: 480,340

[30] Foreign Application Priority Data

June 29, 1973 Switzerland ..... 9505/73

[52] U.S. Cl. ..... 8/17; 8/19; 8/142; 8/149

[51] Int. Cl.[2] ..... D06M 13/00; D06P 5/22

[58] Field of Search ..... 8/17, 19, 142; 8/149

[56] References Cited

UNITED STATES PATENTS

| | | | |
|---|---|---|---|
| 1,979,818 | 11/1934 | Baker | 8/19 |
| 2,956,898 | 10/1960 | Fleck | 8/1 W |
| 3,031,253 | 4/1962 | Gilbert et al. | 8/177 |
| 3,238,011 | 3/1966 | Lawrence et al. | 8/142 |
| 3,617,204 | 11/1971 | Pirie | 8/19 |
| 3,642,644 | 2/1972 | Grote et al. | 8/142 |
| 3,762,862 | 10/1973 | Cunningham et al. | 8/142 |

OTHER PUBLICATIONS

Schmidlin, Preparation and Dyeing of Synthetic Fibers, 1963 Chapman & Hall Ltd., London, pp. 70–76 and 83–86.

*Primary Examiner*—Ronald W. Griffin
*Attorney, Agent, or Firm*—Joseph G. Kolodny; Edward McC. Roberts; Prabodh I. Almaula

[57] ABSTRACT

Continuous process for the optical brightening and printing of organic fiber material, wherein the material is dry cleaned and at least one optical brightener applied from an organic liquor, the said material being then intermediately dried, printed, and subsequently finished by a heat treatment.

19 Claims, No Drawings

CONTINUOUS PROCESS FOR OPTICAL BRIGHTENING AND PRINTING OF ORGANIC TEXTILE FIBER MATERIAL

The invention relates to a continuous process for the optical brightening of organic fibre materials, particularly synthetic fibre material, as well as to the organic fibre material optically brightened by means of this process.

A process is known from the article by Schoenfeldt in Textilveredlung 1 (1966), No. 8, pg. 397–398, for the optical brightening of in particular texturized polyamide and polyester knitted material from an aqueous medium by the pad-steam method. This article mentions the possibility of printing the goods directly after padding and drying, and then subsequently fixing the print and the optical brightener simultaneously by steaming. This process in this order has not found its way into practice, since the properties of water (poor wetting capacity, high viscosity, etc.) are disadvantageous for a wet-on-wet application for textile finishing of articles normally processed.

It is also generally known to optically brighten organic fibre materials, particularly those of a synthetic nature, from organic solvent liquors and, for example, subsequently print them. For this purpose, the untreated material (print ground) passes through a two-stage process in which firstly it is washed with water or organic solvent, and the optical brightener then applied and subsequently developed, the thus pretreated material then passing through a third operation in which it can be, for example, printed.

With the introduction of continuously operating solvent scouring machines fitted with application devices, e.g. with a padder or slop-padding roller for, among other things, textile chemicals, mounted before the drying section of the machine, the continuous solvent scouring of print grounds also becomes of interest. It is namely possible with this equipment to effect the scouring of print grounds, preferably those consisting of synthetic fibre material, in a rapid and thorough manner and without difficulty — which is in contrast to conventional aqueous scouring.

A process has now been found which renders possible, e.g. on continuous scouring machines with an application device, the scouring of the material together with application of an optical brightener as an integrated process. The two operations of scouring from solvents and application of the optical brightener can thus be performed in a single stage.

This single-stage procedure is made possible on the one hand by the feasibility of combining the process of shrinking the textile material, preferably synthetic fibre material, with the scouring of the material in organic solvents, and on the other hand by virtue of the excellent wetting and penetration properties of the organic solvents used for the application process, with the result that high machine-operational speeds are attained with a satisfactory uniform quality of the optically brightened material thus obtained.

The development and fixing of the optical brightener is then performed in a following printing process. This procedure offers the possibility of employing optical brighteners not normally suitable for continuous processes. The process according to the invention has the further advantage of allowing surface-fixing processes which may be necessary to be performed by gentle heat treatment, a factor which is of great advantage for, in particular, textured synthetic fibre material which, as is known, require very gentle thermofixing.

The process according to the invention comprises the dry cleaning and shrinking of organic fibre materials, advantageously in the form of printing bases, in an organic solvent, particularly in halogenated hydrocarbons, or in an emulsion of solvent and water; and then the direct application, preferably wet-on-wet, of at least one optical brightener from an organic solution, emulsion or dispersion; and subsequent drying. Advantageously, these dried materials are afterwards printed, and fixed by means of a dry or wet heat treatment.

The most varied kinds of organic fibre materials are suitable: They are preferably synthetic fibre materials, such as polyester materials, e.g. made from ethylene glycol and terephthalic acid, or cellulose triacetate; or polyamide materials, such as polyamide-6, polyamide-6.6, polyamide-6.10, or polyacrylonitrile materials.

Equally suitable for use are also fibre materials made from cellulose-2½-acetate, from viscose or copper spun rayon, or from pre-bleached cotton.

In addition, this process is suitable for mixed fabrics, such as, for example, from those polyester/cotton, polyamide/cotton and polyester/viscose.

These materials are preferably used as grey goods, i.e. as ready-to-print material (printing grounds or bases), in any desired stage of processing, such as, e.g. as fabrics or knitted goods.

The treatment according to the invention is performed by a procedure comprising firstly the dry cleaning and the shrinking of, for example, the said printing grounds of these materials either in a solvent of in an emulsion; and by solvents are meant in this case hydrophobic, organic solvents, i.e. those which are not miscible with water or miscible only to a very limited degree, such as hydrocarbons, e.g. heavy petrol, or optically halogenated aromatic hydrocarbons, such as chlorobenzene, or halogenated aliphatic hydrocarbons, such as 1,1,1-trichloroethane, 1,1,2-trichloro-2,2,1-trifluoroethane, carbon tetrachloride, tri- or tetrachloroethylene or dibromoethylene. If an addition be made to these hydrophobic organic solvents of small amounts of water, ca. 0.05 to 2 percent by weight, with application of an emulsifier (=dry cleaning detergent) for water-in-perchloroethylene emulsions, then an emulsion is obtained, which likewise can be used. Optionally, the dry cleaning process may also be carried out at elevated temperature in order to facilitate the shrinkage of the fibre material. There is then applied direct, preferably wet-on-wet, i.e. without intermediate drying, to the thus preliminarily prepared printing bases at least one optical brightener from a solution, emulsion or dispersion, for example, by slop padding, whereby the solution of this optical brightener can be in one or more of the above-mentioned hydrophobic organic solvents, preferably in perchloroethylene.

Usable according to the invention are also solutions of optical brighteners in a mixture of a hydrophobic organic solvent with a hydrophilic organic solvent; and by hydrophilic organic solvents are meant solvents miscible with water, such as, for example, aliphatic alcohols, e.g. methanol, ethanol, n-propanol or isopropanol; ketones, such as acetone, methyl ethyl ketone and cyclohexanones; ethers and acetals, such as dioxane, tetrahydrofuran, glycerin formal and glycol formal or diacetone alcohol, also higher-boiling glycol derivatives, such as ethylene glycol monomethyl ether, -ethyl ether and -butyl ether, and diethylene glycol monomethyl ether or -ethyl ether, and diethylene glycol monomethyl ether or -ethyl ether, thioglycol, γ-butyrolacetone, and particularly the group of water-miscible active solvents boiling above 120°C, such as N,N-dimethylformamide, N,N-dimethylacetamide, methanephosphoric acid-bis-(dimethylamide), N-hexamethylphosphoric acid triamide, N-methylpyrrolidone, 1,5-dimethylpyrrolidone, N,N-dimethylmethoxyacetamide, N,N,N',N'-tetramethylurea and tetramethyleneurea.

The mixture ratio of hydrophobic to hydrophilic solvents is adjusted so that stable application liquors are obtained; as a rule, however, the proportion of hydrophilic solvents is not higher than 10 percent by volume.

Suitable according to the invention for application of the optical brightener are also the aforementioned emulsions of a hydrophobic organic solvent with water or with a hydrophilic solvent such as, e.g. glycerin, glycols such as ethylene glycol, polyethylene glycols having up to 3000 moles of ethylene oxide, or tetramethylene-sulphone (sulpholene), 3-methylsulpholane, ethylene carbonate, propylene carbonate or alkylene carbonates in general. Also suitable, however, are glycolic acid, formic acid, glacial acetic acid, etc.

The mixture ratio of hydrophobic to hydrophilic solvent in the emulsions is, as a rule, 1000:5 to 1000:50 percent by volume. With regard to application of the optical brightener from solvent-in-halogenated-hydrocarbon emulsions, suitable solvents from the series of aforementioned hydrophilic solvents which may be mentioned are, in particular, water, ethylene glycol, polyethylene glycol having 50 to 1000 moles of ethylene oxide, sulpholanes and glycolic acid, it has been further established that the use of emulsifiers is a critical factor.

With the use of the water-in-oil emulsifiers normally employed for this purpose, e.g. based on alkali or alkylamine salts of ether carboxylic acids (e.g. 4-nonyl-2-methylol-phenoxyacetic acid), alkylarylsulphonates, xylene and naphthalenesulphonates, alkylnapthalenesulphonates, sulphuric acid esters of ethoxylated fatty alcohols and alkylphenols, etc., the results ares, especially in the case of emulsions with organic solvents, inadequate emulsion stability and, in particular, unsatisfactory contour sharpness ("Druckstand") on subsequent printing of the textile material.

Surprisingly, it has also been found that the use of emulsifiers based on sulphosuccinic acid esters of the formula

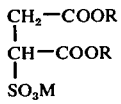

wherein R is alkyl having 3 to 16, preferably 6 carbon atoms and M is an alkali radical or an amine radical, in combination with small amounts of additives of nonionic ethylene oxide adducts, e.g. those of the general formulae $$R_1 - O - (C_2H_4O)_n - H$$

(alkylpolyglycol ether)
wherein $R_1$ is alkyl having 12 to 18 carbon atoms and $n$ is 10 to 35,

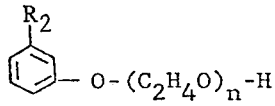

(alkylphenylpolyglycol ether)
wherein $R_2$ is alkyl having 5 to 18 carbon atoms and $n$ is 8 to 50, $$R_3 - CO - O - (C_2H_4O)_n - H$$

(acylpolyglycol ether)
wherein $R_3$ is alkyl having 10 to 35 carbon atoms and $n$ is 8 to 50, ensures not only excellent emulsion stability of the emulsified ionic optical brighteners dissolved in water, and preferably in organic hydrophilic solvents, but also outstanding sharpness of contour of the printings obtained in the following printing process. Ionic optical brighteners are very important for the brightening of polyamide and polyacrylonitrile, since they afford the best white effects.

The emulsifiers are advantageously employed in amounts of from 0.5 to 15 grams per liter, preferably 2.5 to 5 grams per liter of liquor with the addition of small amounts of nonionic ethylene oxide adducts (5 to 30%, preferably 10% of the amount of emulsifier used).

The preparation of optical-brightener dispersions in the organic solvents, especially in halogenated hydrocarbons, can in general be effected without use of dispersing agents if the optical brighteners have a particle size of $<10\mu$. Preparation of this kind are obtained by the grinding of the optical brighteners by known methods, e.g. by means of microgrinding with the use of, e.g. quartz sand, glass beads, etc., in an inert organic solvent, preferably in halogenated hydrocarbons.

The dispersions of the optical brighteners in halogenated hydrocarbons have in general very good stability, since the specific weights of the dispersed products and of the solvents for application, preferably halogenated hydrocarbons, are very similar. For extreme cases, however, these dispersions can be further stabilised with small amounts of solvent thickeners, e.g. by the addition of cellulose derivatives, e.g. acetyl cellulose or sodium cellulose glycolate.

It is also possible, however, for application of the optical brighteners to the organic textile material to be effected not wet-on-wet in the preferred single-stage process, but wet-on-dry, i.e. by a process in which the optical brightener is applied to the dry, previously scoured printing base.

Suitable optical brighteners are organic compounds containing at least 4 conjugated double bonds. Depending on affinity for the substrate, use is made of anionic, cationic or nonionic optical brighteners which, from a chemical viewpoint, belong to the most varied classes, such as the methine, azamethine, benzimidazole, coumarin, naphthalimide, pyrazoline, stilbene, benzocoumarin, pyrazine, oxazine, dibenzoxazolyl, distilbyldiphenyl, phenylcoumarin or stilbyl-naphthotriazole series. Ionic optical brighteners can be used not only in the forn of their organic salts but also in the form of organic salts; e.g., anionic optical brighteners as amine, isothiuronium salts, etc., and cationic optical brighteners as fatty acid salts.

The amounts in which the optical brighteners can be added to the application bath can vary depending on the desired degree of optical brightening; in general, amounts of ca. 1 to 10 g/l of liquor have proved satisfactory.

The organic textile material thus treated either wet-on-wet or wet-on-dry with optical brightener is subsequently dried, and optionally stabilised dimensionally under mild conditions; it can then be printed advantageously on a printing machine, e.g. in the film printing process, in the known manner. Applicable dyestuffs for printing are, depending on the substrate, e.g. dispersion dyestuffs for polyester and cellulose acetate materials; acid dyestuffs for polyamide; basic dyestuffs for polyacrylonitrile; and direct dyestuffs or reactive dyestuffs for cellulose materials.

Fixing of the printing and advantageously also development of the optical brightener are performed together by means of a subsequent wet on dry heat treatment.

By wet heat treatment is meant, e.g. treatment with saturated steam or superheated steam, whilst a dry heat treatment consists, e.g. of treatment with hot air at about 80° to 230°C.

After this heat treatment, the printed and optically brightened organic textile material is given a finishing treatment.

The process according to the invention is characterised by its simplicity and, in particular, by the integration of processes so that, while maintaining the quality of the brightening effects and printing, the dry cleaning process and the application of the optical brightener are performed in a single stage, followed by development of the optical brightener in the printing process.

By virtue of the special properties of perchloroethylene (good wetting, low viscosity, etc.), the application presents no difficulties; e.g. it may be applied by simple slop padding. Moreover, the process according to the present invention saves considerably on energy, since only a fraction of that required for drying from an aqueous medium is required for vaporization of perchloroethylene.

In cases where application of the optical brightener is effected from an emulsion system, there results moreover, by virtue of the application of specific emulsifiers, no impairment of contour sharpness, so that printings are obtained which display an excellent sharpness of outline.

The following examples serve to illustrate the invention without limiting the scope thereof.

Temperatures are expressed in degrees Centigrade, and the term 'parts' denotes parts by weight. The optical brighteners and dyestuffs used are known.

EXAMPLE 1

A piece made from textured polyester tricot, 10 m long, 125 cm wide and having a surface weight of 235 g/m² (Diolen-loft), coming direct from scouring with perchloroethylene at a temperature of 60° and having been squeezed out to ca. 100%, is slop padded wet-on-wet with a solution (5 g/l) of the optical brightener of the formula

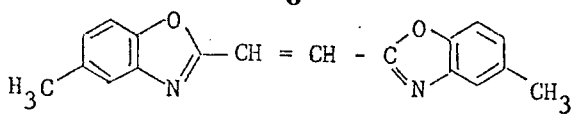

in perchloroethylene, and then immediately dried at 115°. (The slop padding apparatus operates with a roller lead of 100%; i.e. the padding roller has a peripheral speed amounting to double the material speed of 12 m/min. With this procedure, the amount of liquor applied by the padding roller is of the order of 30 percent by volume of solution).

The dried piece is then optionally dimensionally stabilised at 150° for 30 seconds.

The dried tricot piece is subsequently printed in the film printing process with use of the following printing paste composition:

500 g of a 12% aqueous solution of a modified carob bean flour ether derivative,
430 g of water,
50 g of a 10% aqueous solution of the sodium salt of m-nitrobenzenesulfonic acid, and
20 g of the dyestuff of the formula

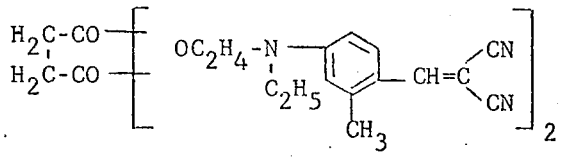

The material after printing is dried in hot air at 80° to 150°, and subsequently steamed in saturated steam at 1.5 bars for 20 minutes.

The material is afterwards rinsed with cold water, then reductively rinsed for 15 minutes at 50°–60° with the addition of 2 g of sodium dithionite per liter and 3 g of 30% aqueous solution of NaOH per liter, and subsequently again rinsed with cold water and finally dried.

The resulting yellow printing is characterised by an exceptional sharpness of outline; the white parts of the printed design display a high degree of brightening, and the colouring of the printing is of a brilliant shade.

If the material is steamed with superheated steam at 160° to 180° for 6 to 8 minutes, instead of with saturated steam for 20 minutes, or is treated with hot air at 190° to 210° for 20 to 60 seconds, with otherwise the same procedure, then equally good results are obtained.

The same good results are obtained if the 20 g of the dyestuff in the above printing paste is replaced by identical parts of the following dyestuffs, with the procedure otherwise remaining the same:

| Example | Dyestuff |
|---|---|
| 2 | 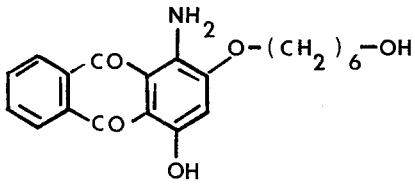 |

-continued

| Example | Dyestuff |
|---|---|
| 3 | 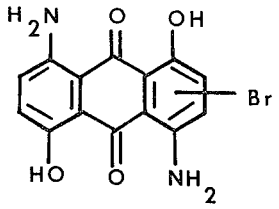 |

EXAMPLE 4

If, instead of the optical brightener used in Example 1, one of the following listed optical brighteners is used in an amount in each case of 5 g/l, the procedure otherwise remaining unchanged, then equally good optical brightening effects are obtained.

| Example No. | Optical brightener |
|---|---|
| 4 | 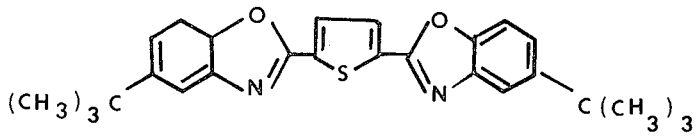 |
| 5 | 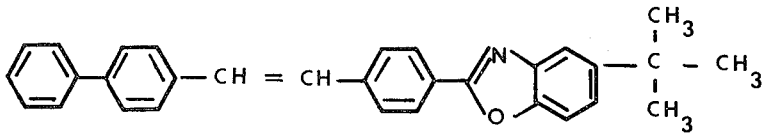 |
| 6 | 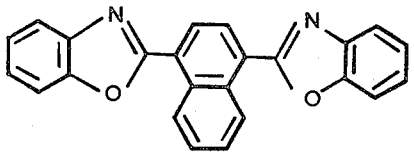 |
| 7 | 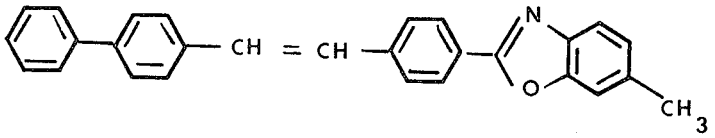 |

EXAMPLE 8

A polyester staple fabric (Dacron) is pretreated in perchloroethylene, squeezed out to 80% relative to the dry weight of the material, and padded wet-on-wet with a dispersion of 5 g per liter of the optical brightener of the formula

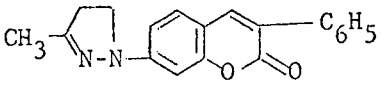

in perchloroethylene; it is then squeezed out to 120% relative to the dry weight of the fibre material.

The ground brightener is present in perchloroethylene with a particle size of <5$\mu$. The grinding is performed e.g. for 5 hours using glass beads ($\phi$2 mm) in a weight ratio of formulation to glass beads of 10 : 1. Stabilisation of the dispersion in the padding liquor is effected with 3 g per liter of ethylcellulose as thickening agent, this having been dissolved in the liquor before addition of the brightener-dispersion.

After drying, the fabric is printed as described in Example 1. A printing is obtained which has a perfectly evenly brightened base, and which displays an excellent white effect.

If, instead of 5 g per liter of optical brightener of the above formula, identical parts of the following optical brighteners are used, with otherwise the same procedure, then equally good optical brightening effects are obtained.

| Example No. | Optical brightener |
|---|---|
| 9 | 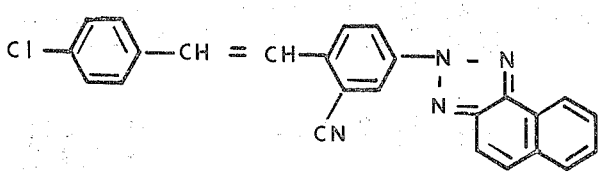 |
| 10 | 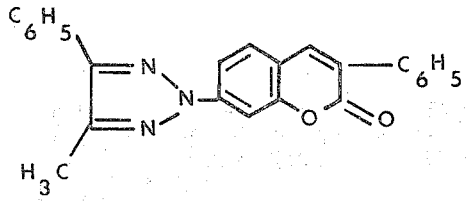 |
| 11 | 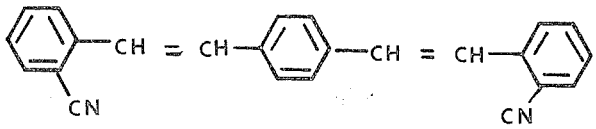 |
| 12 | 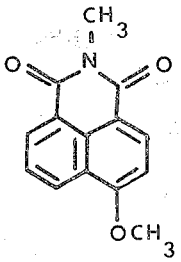 |

EXAMPLE 13

A piece of textured polyamide tricot (Helanca), scoured in perchloroethylene, is padded in solvent-moist condition (perchloroethylene content 90%) with a solution of 3 g of the optical brightener of the formula

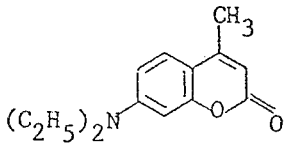

in 1 liter of perchloroethylene. After padding, the material is squeezed out to 150%, calculated on the dry weight of the polyamide material. The textile material is subsequently dried at 130° free from perchloroethylene and, optionally, dimensionally stabilised for 30 seconds at 150°.

The tricot piece prepared in this manner is printed by the film-printing process in the following manner:

A printing paste of the following composition is prepared: 20 g of the dyestuff of the formula

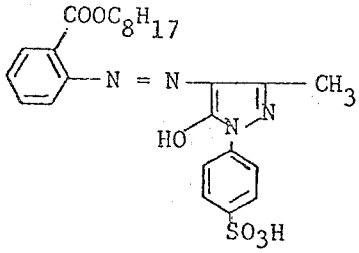

is dissolved with 100 g of urea, 50 g of thiodiethylene glycol and 250 to 270 ml of boiling water; to the solution are then added 500 ml of a 12% aqueous solution of a carob bean flour ether derivative and 60 g of an aqueous solution of ammonium tartrate 15°Be. The prepared tricot piece is printed with this printing paste, and afterwards dried with hot air at 80° to 150°.

Fixing of the dyestuff and development of the optical brightener are subsequently performed by a steaming operation with saturated steam at O bar for 15 to 30 minutes. Finally, the printed tricot piece is rinsed cold, washed at 50° for 10 minutes in a washing bath containing 2 g of a nonionic detergent per liter (e.g. nonylphenol polyglycol ether having 10½ moles of ethylene oxide), again rinsed cold and then dried.

The result is a yellow printing having excellently brightened white parts and very good sharpness of outline.

If, instead of 20 g of the above dyestuff, the following dyestuffs are used in the given amounts, with otherwise the same procedure, then printings having equally good properties are obtained.

| Example No. | Dyestuff /amount | Shade on textured polyamide |
|---|---|---|
| 14 | 30 g | red |

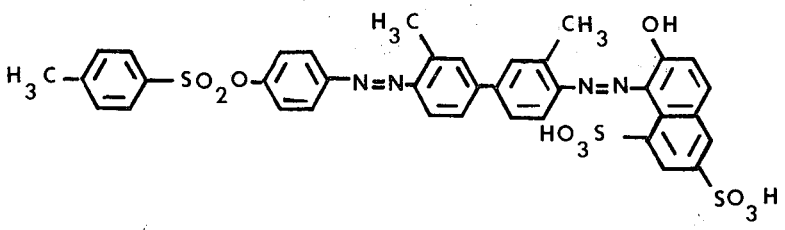

| | | |
|---|---|---|
| 15 | 40g | blue |

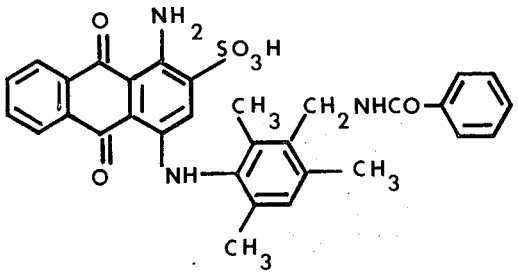

EXAMPLE 16

If, instead of the optical brightener used in Example 13, identical amounts of the optical brightener of the formula

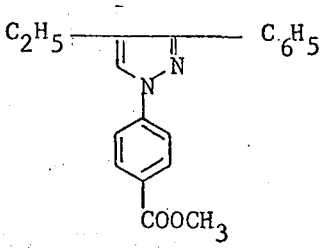

are used, the procedure otherwise remaining the same as in Example 13, then equally good optical brightening effects are obtained.

EXAMPLE 17

If, instead of the optical brightener used in Example 13, identical amounts of the optical brightener of the formula

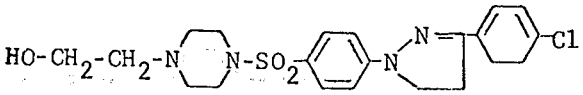

are used, the procedure being otherwise the same, then equally good brightening effects are obtained. The optical brightener can be pre-dissolved with N-methylpyrrolidone 1:20, and this solution then added to the perchloroethylene liquor.

EXAMPLE 18

If, instead of the optical brightener according to Example 13, identical amounts of an optical brightener of the formula

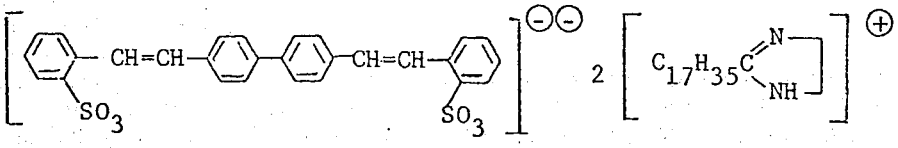

are used, with otherwise the same procedure, then equally good optical brightening effects are obtained.

EXAMPLE 19

A piece made from porous perlon tricot scoured in perchloroethylene, is padded in the still solvent-moist state (perchloroethylene content ca. 75%) with a liquor prepared as follows:

6 g of the sodium salt of 2-di-(ethylhexyl)-sulphosuccinate and 1 g of nonylphenol polyglycol ether having 35 moles of ethylene oxide are dissolved, with stirring, in 1 liter of perchloroethylene; into this solution is then emulsified an amount of 10 g of a solution of 1.5 g of the optical brightener of the formula

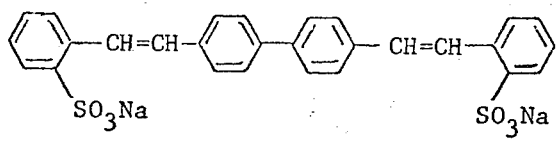

in a mixture of 75 parts by weight of ethylene glycol and 25 parts by weight of polyethylene glycol (mol. weight 300).

The tricot piece is squeezed out to the extent of 105%, calculated on the dry weight of the fibre material. The tricot piece is subsequently dried at ca. 130°; and the tricot material thus prepared is afterwards printed according to the procedure described in Example 13.

The printed tricot piece displays in its white portion a very good brightening effect.

EXAMPLE 20

The same procedure as described in Example 13 is applied except that in this case the application liquor is prepared by emulsifying a solution of 1 g of the optical brightener of the formula

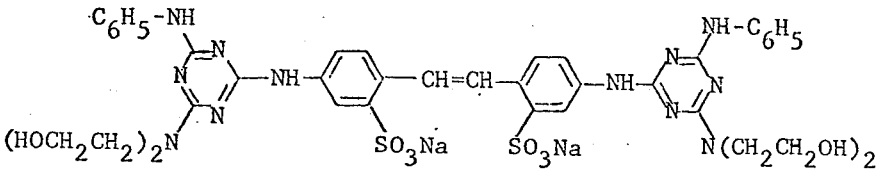

in 15 ml of water into the surfactant-containing liquor described in Example 19.

EXAMPLE 21

A piece made from textured polyamide tricot (Helanca), scoured in perchloroethylene, is slop padded, with a roller lead of 60%, in the solvent-moist condition (perchloroethylene content 105%) with a dispersion of the optical brightener of the formula

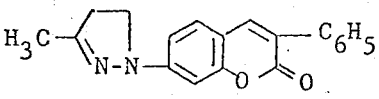

and afterwards immediately dried at 120°. (The application solution is obtained by dissolving 3.5 g of ethylcellulose in 1 liter of perchloroethylene, and dispersing in this solution 30 g of a 15% sand grinding (in perchloroethylene) of the above brightener [particle size ca. 6 μ].

The polyamide material preliminarily prepared in this manner is subsequently printed according to the procedure described in Example 13. The result obtained is a high degree of whiteness of the white parts and a very good sharpness of outline.

EXAMPLE 22

A piece made from polyacrylonitrile tricot (Orlon), scoured and shrunk, is padded in the still solvent-moist condition (content of perchloroethylene 90%) with a solution of 3 g of the optical brightener of the formula

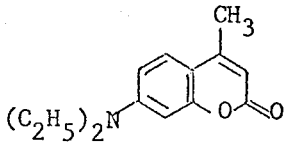

per liter of perchloroethylene (squeezing effect ca. 120%), and afterwards dried at 105°. The tricot piece is subsequently printed by the film printing process with the printing paste of the following composition: 500 g of 12% aqueous solution of a modified carob bean flour ether derivative, 415 g of water, 30 g of tartaric acid (1:1 dissolved in water), 30 g of a 10% aqueous solution of dinaphthalene sulphonate/formaldehyde and 25 g of the dyestuff of the formula

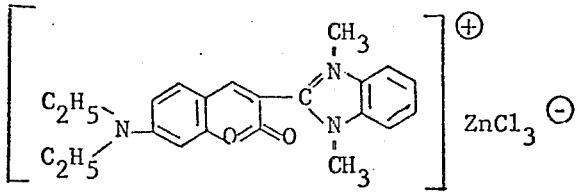

After printing of the tricot piece, this is dried in hot air at 120°, and then fixed at 0.3 bar for 30 minutes in saturated steam. The optical brightener is developed simultaneously with this operation.

After steaming, the tricot piece is rinsed with cold water; it is subsequently washed with 0.5 ml of sodium hydroxide solution 36°Be per liter, 1 g of sodium dithionite per liter and 1 g of a nonionic detergent per liter (e.g. nonylphenol polyglycol ether having 10.5 moles of ethylene oxide) at 40° for 20 minutes, and then thoroughly rinsed hot and finally dried.

The tricot piece printed greenish-yellow has its white section outstandingly brightened, and displays an excellent sharpness of outline.

If, instead of the 25 g of the above dyestuff, the same amount of the following dyestuffs are used, with the procedure otherwise unchanged, then similarly good results are obtained.

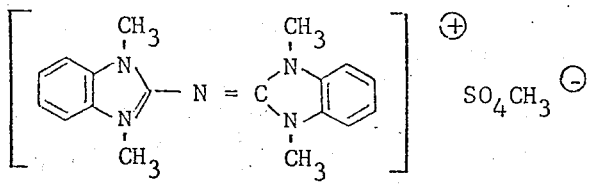

| Example No. | Dyestuff |
|---|---|
| 23 | 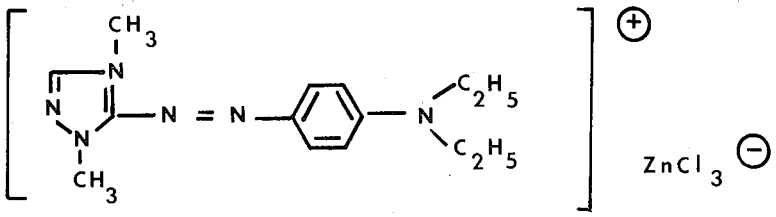 |
| 24 | 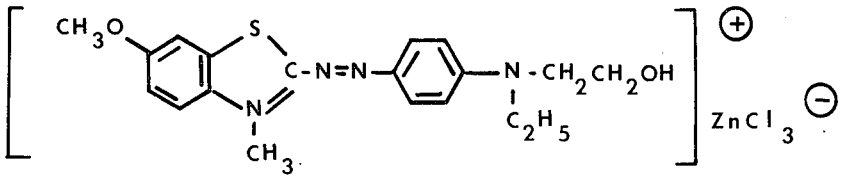 |
| | or 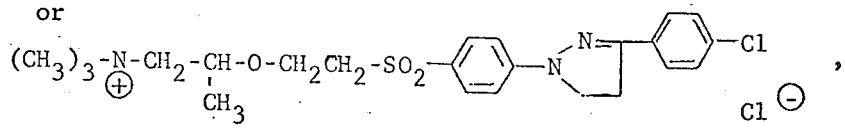 , |
| | or 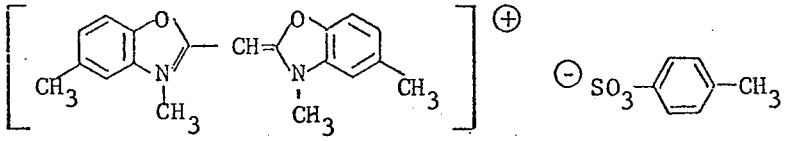 |

EXAMPLE 25

If, instead of the optical brightener according to Example 22, one of the formula

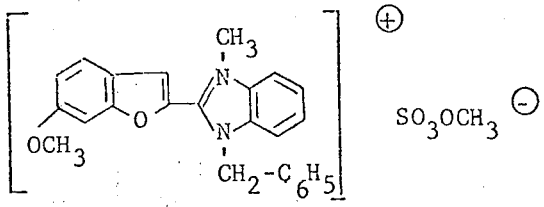

is used, then similarly good brightening effects are obtained.

The application liquor of this brightener is prepared as follows: In 1 liter of perchloroethylene there are dissolved 6 g of the sodium salt of 2-di-(ethylhexyl)-sulphosuccinate per liter and 1 g of nonylphenyl polyglycol ether having 35 moles of ethylene oxide, per liter; an amount of 2 g of the brightener of the above formula, dissolved in 15 ml of water and 5 ml of 85% formic acid, is then emulsified into the solution.

Padding is carried out with this solution: the tricot piece is dried, and subsequently printed as described in Example 1.

EXAMPLE 26

If, instead of the optical brightener according to Example 22, an optical brightener of the formula is used, with otherwise the same procedure, then equally good optical brightener effects are obtained.

EXAMPLE 27

A piece made from textured polyester tricot (Crimplene) is dry cleaned in perchloroethylene, dried and then subsequently padded with a solution of 3 g of the optical brightener according to Example 1 in one liter of perchloroethylene. The squeezing effect, calculated on the dry weight of the textile material, is 120 percent by weight. The material is afterwards dried at 110°, subsequently dimensionally stabilised at 150° for 30 seconds, and printed by the film printing process as described in Example 1. A very well optically brightened yellow polyester printing is obtained.

EXAMPLE 28

A mixed fabric made from polyester/viscose spun rayon (mixture ratio 67/33) is squeezed out, immediately after the scouring process with perchloroethylene, to ca. 80% of the dry weight of the material, and then impregnated wet-on-wet with a liquor containing 2 g per liter of the optical brightener according to Example 1 in the dissolved form (for the polyester part) and 10 g per liter of the solution of the optical brightener according to Example 19 (for the cellulose part), which is emulsified with 6 g per liter of the sodium salt of 2-di- (ethylhexyl)-sulphosuccinate.

The squeezing effect after application of the brightener liquor is 110%, calculated on the dry weight of the fibre material. The material is subsequently dried at 120°, and printed with the following printing-paste composition: 40 g of the dyestuff of the formula

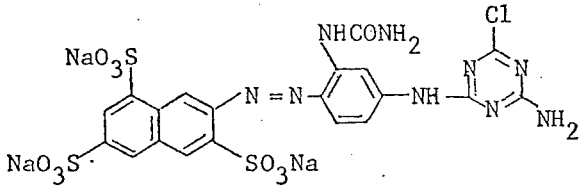

and 30 g of the dyestuff mixture (1:1) of the formulae

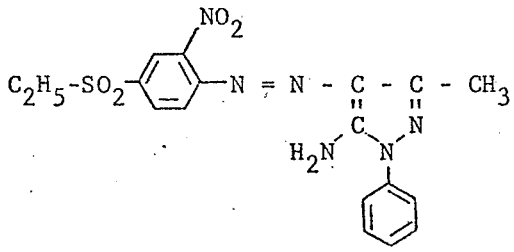

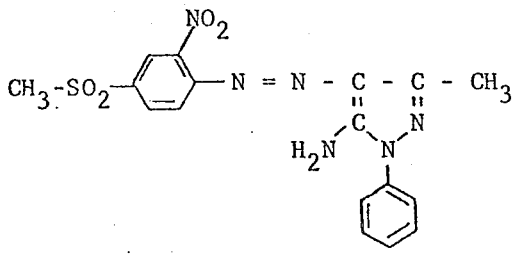

are stirred, by means of a high-speed stirrer, into 930 g of a stock thickening consisting of 500 g of alginate thickening (low viscosity), 410 g of water, 50 g of urea, 20 g of sodium bicarbonate, 10 g of the sodium salt of nitrobenzenesulphonic acid and 10 g of nonylphenol polyglycol ether (35 ethylene oxide). The mixed fabric is printed with this printing paste by the roller printing method, then steamed for 8 minutes at 102°, and subsequently steam-fixed for 6 minutes at 160° under high temperature conditions.

The material is afterwards rinsed with cold water (10 minutes); it is then soaped at 60° for 10 minutes and at 90° for 10 minutes, in each case with a fresh bath with the addition of 2 g of nonylphenol polyglycol ether (10 ethylene oxide) per liter; the material is subsequently rinsed cold and dried.

The printing has a very good sharpness of outline and the white parts display a high degree of brightening.

We claim:

1. Continuous process for the optical brightening and printing of organic textile fibre material, wherein the material is dry cleaned and at least one optical brightener applied from an organic liquor, the said material being then intermediately dried, printed, and subsequently finished by a heat treatment to simultaneously develop the optical brightener and fix the dyestuff.

2. Process according to claim 1, wherein the dry cleaning and the application of the optical brightener are performed wet-on-wet in one stage.

3. Process according to claim 1, wherein there are used, as organic liquor, halogenated aliphatic hydrocarbons, alone or as an emulsion in water.

4. Process according to claim 3, wherein the organic liquor is perchloroethylene.

5. Process according to claim 1, wherein the heat treatment is wet.

6. Process according to claim 5, wherein the heat treatment is preformed with saturated steam or with superheated steam.

7. Process according to claim 1, wherein the organic fibre material used is synthetic fibre material.

8. Process according to claim 7 wherein the synthetic fibre material is polyester material, polyamide material or polyacrylonitrile material.

9. Process according to claim 1 comprising in a single stage the dry cleaning of printing grounds of organic fibre material and the application of optical brightener.

10. Process according to claim 1, wherein polyester material is dry cleaned, treated wet-on-wet with optical brightener, intermediately dried, printed with a printing paste containing dispersion dyestuff and finished by a steam treatment.

11. Process according to claim 1, wherein at least one optical brightener is applied from an emulsion, using at least one emulsifier of the Formula I

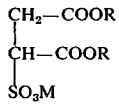

wherein R is alkyl having 3 to 16 carbon atoms and M is an alkali radical or an amine radical.

12. Process according to claim 11, wherein a minor amount of a non-ionogenic ethylene oxide adduct is added to the emulsion.

13. Process according to claim 12, wherein polyamide or polyacrylonitrile is used.

14. Process according to claim 12, wherein the non-iongenic ethylene oxide adduct is of the Formula II $$R_1 - O - (C_2H_4O)_n - H$$

wherein $R_1$ is alkyl having 12 to 18 carbon atoms and $n$ is 10 to 35, of the Formula III

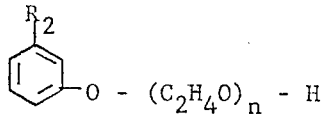

wherein $R_2$ is alkyl having 5 to 18 carbon atoms and n is 8 to 50, or of the Formula IV $R_3 - CO - O - (C_2H_4O)_n - H$ wherein $R_3$ is alkyl having 10 to 35 carbon atoms and $n$ is 8 to 50.

15. Process according to claim 14 wherein 0.5 to 15 grams of emulsifier of the Formula I per liter of liquor is employed.

16. Process according to claim 15 wherein 2.5 to 5 grams of emulsifier are used.

17. Process according to claim 14, wherein 0.5 to 15 grams of emulsifier of the Formula I per liter of liquor and 5 to 30%, calculated on the emulsifier of Formula I, of a non-ionic ethylene oxide adduct of the Formula II, III or IV is employed.

18. Process according to claim 17 wherein 2.5 to 5 grams of emulsifier are used.

19. The organic fibre material optically brightened and printed by the process of claim 1.

* * * * *